US011118423B1

(12) United States Patent
Helms et al.

(10) Patent No.: US 11,118,423 B1
(45) Date of Patent: Sep. 14, 2021

(54) DOWNHOLE TOOL FOR USE IN A BOREHOLE

(71) Applicant: Halliburton Energy Services, Inc., Houston, TX (US)

(72) Inventors: Lonnie Helms, Humble, TX (US); Frank Acosta, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/863,738

(22) Filed: May 1, 2020

(51) Int. Cl.

| | |
|---|---|
| ***E21B 34/06*** | (2006.01) |
| ***E21B 33/128*** | (2006.01) |
| ***E21B 34/14*** | (2006.01) |
| ***E21B 33/12*** | (2006.01) |

(52) U.S. Cl.
CPC ..... *E21B 34/063* (2013.01); *E21B 33/128* (2013.01); *E21B 33/1208* (2013.01); *E21B 34/142* (2020.05); *E21B 2200/06* (2020.05); *E21B 2200/08* (2020.05)

(58) Field of Classification Search
CPC .... E21B 34/063; E21B 34/142; E21B 33/128; E21B 33/1208; E21B 2200/06; E21B 2200/08
See application file for complete search history.

(56) References Cited

U.S. PATENT DOCUMENTS 4,658,896 A * 4/1987 Milam ..... E21B 17/1078 166/241.6
10,233,717 B2 3/2019 Hered
2006/0144591 A1* 7/2006 Gonzalez ..... E21B 33/13 166/277
2006/0185856 A1* 8/2006 Steele ..... E21B 43/103 166/380
2007/0284037 A1 12/2007 Buytaert
2011/0094742 A1 4/2011 Badalamenti
2012/0211283 A1* 8/2012 DiGiovanni ..... B24D 3/10 175/428
2012/0255742 A1 10/2012 Cortez
(Continued)

FOREIGN PATENT DOCUMENTS

WO 2017011029 A1 1/2017

OTHER PUBLICATIONS

Cinar et al., Mechanical Fracturing of Core-Shell Undercooled Metal Particles for Heat-Free Soldering, Scientific Reports 6, Article No. 21864 (2016) doi:10.1038/srep21864.
(Continued)

*Primary Examiner* — Christopher J Sebesta
(74) *Attorney, Agent, or Firm* — Chamberlain Hrdlicka

(57) ABSTRACT

A downhole tool for use within a borehole. The downhole tool may include a body including a port that allows fluid flow between a bore of the downhole tool and an area outside of the body and a sleeve slidable from a run-in position to an actuated position. Either the run-in position or the actuated position may prevent flow through the port. Additionally, at least one of an end of the sleeve or a surface of the body may be coated in solder particles having an outer shell and a liquid metal core. Further, the solder particles may be rupturable when the sleeve is shifted to the actuated position into contact with the surface to expose the liquid metal such that the liquid metal solidifies and forms a bond to retain the sleeve in the actuated position.

15 Claims, 5 Drawing Sheets

(56) References Cited

U.S. PATENT DOCUMENTS

| | | | | |
|---|---|---|---|---|
| 2013/0133876 | A1 | 5/2013 | Naedler | |
| 2013/0206425 | A1* | 8/2013 | Mazyar | E21B 33/12 166/376 |
| 2015/0021047 | A1 | 1/2015 | Buytaert et al. | |
| 2015/0315868 | A1 | 11/2015 | Fripp | |
| 2017/0183937 | A1 | 6/2017 | Harper | |
| 2017/0370186 | A1 | 12/2017 | Stair | |
| 2018/0252091 | A1* | 9/2018 | Bustos | E21B 47/06 |
| 2019/0003282 | A1* | 1/2019 | Doherty | E21B 34/14 |
| 2019/0277109 | A1 | 9/2019 | Bowersock | |
| 2020/0362675 | A1* | 11/2020 | Anderson | E21B 43/116 |

OTHER PUBLICATIONS

International Search Report and The Written Opinion of the International Search Authority dated Feb. 3, 2021 for PCT Application No. PCT/US2020/035100 filed May 29, 2020.

International Search Report and The Written Opinion of the International Search Authority dated Feb. 18, 2021 for PCT Application No. PCT/US2020/035106 filed May 29, 2020.

International Search Report and The Written Opinion of the International Search Authority dated Jan. 22, 2021 for PCT Application No. PCT/US2020/031277 filed May 29, 2020.

* cited by examiner

DOWNHOLE TOOL FOR USE IN A BOREHOLE

BACKGROUND

This section is intended to provide relevant background information to facilitate a better understanding of the various aspects of the described embodiments. Accordingly, it should be understood that these statements are to be read in this light and not as admissions of prior art.

Boreholes are drilled into the earth for a variety of purposes including accessing hydrocarbon bearing formations. A variety of downhole tools may be used within a borehole in connection with accessing and extracting such hydrocarbons. Throughout the process, it is necessary to retain one or more components of the various downhole tools in a fixed position or maintain contact between two downhole tools once the downhole tools have been positioned within the borehole.

For example, when cementing a casing within the borehole, downhole sleeve valves are often used to control the flow of cement into an annulus formed between the casing and the borehole wall. Once the sleeve valves are positioned within the borehole, they are shifted into an operating position and must maintain the operating position throughout the cementing operation.

Additional downhole tools are commonly employed through the borehole on a tool string such as a wireline, work string, or production tubing for performing completion and/or treatment operations. Such downhole tools must be set within the borehole upon reaching a target location within the borehole. Further, plugs and similar devices may be pumped downhole and contact a seat of a downhole tool to prevent flow through the downhole tool during completion and/or treatment operations. Such plugs must be maintained against the seat to prevent damage to the formation downhole of the plug while the completion and/or treatment operations are conducted uphole of the plug.

BRIEF DESCRIPTION OF THE DRAWINGS

Embodiments of the downhole are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a downhole tool for use in a borehole. The downhole tool includes one or more surfaces that are coated in a solder suspension configured to bond the coated surface to another surface upon contact between the two surfaces.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
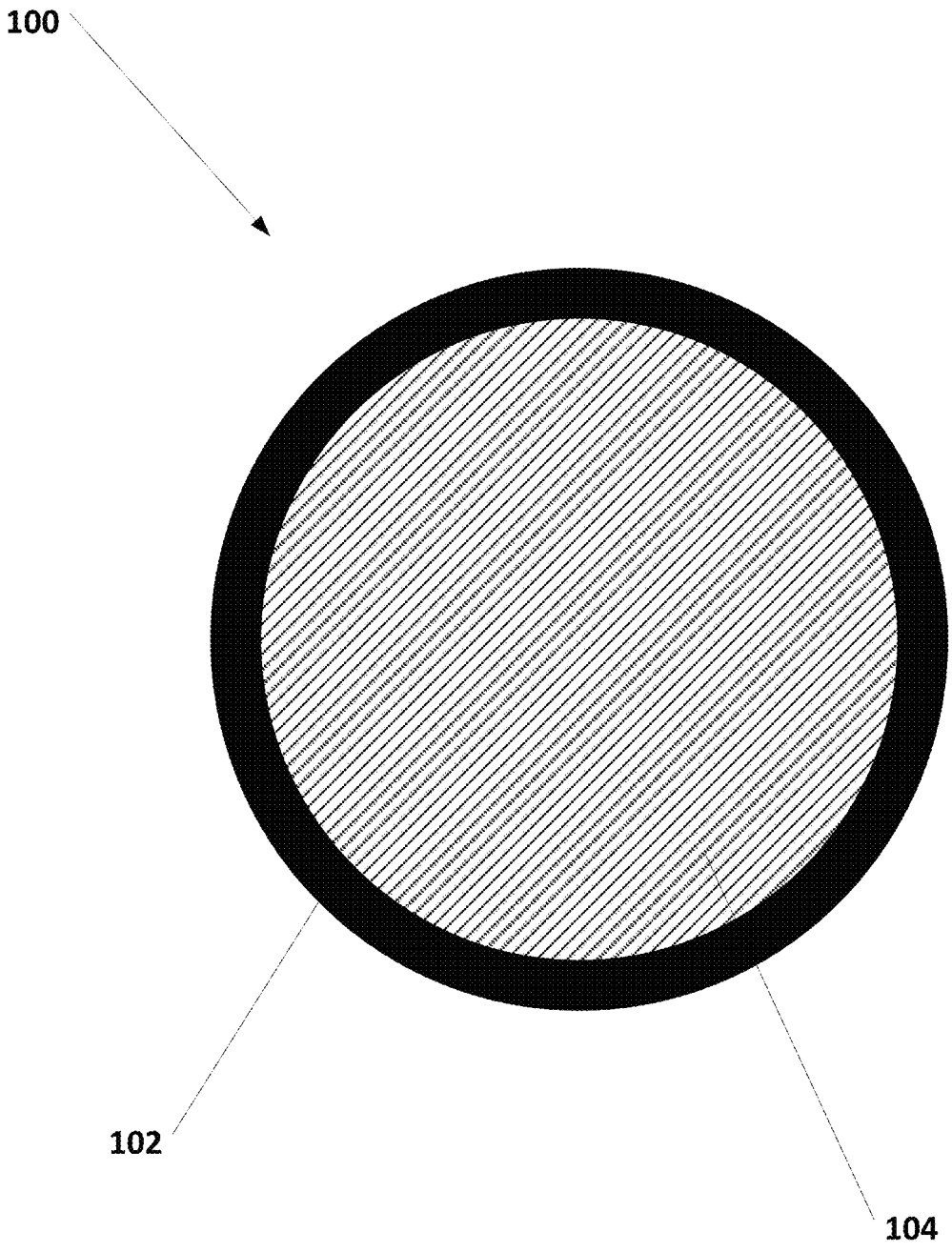
FIG. 1 is a cross-sectional view of a solder particle, according to one or more embodiments.

FIG. 1 is a cross-sectional view of a solder particle 100, according to one or more embodiments. To form the solder particle, a eutectic metal alloy is melted to form a liquid. The liquid eutectic metal is then combined with an acid-containing carrier fluid and a rotating implement is used to shear the liquid metal to form nanoparticles and/or microparticles of the liquid eutectic metal.

After the nanoparticles and microparticles have formed, a chemical reaction occurs that results in the oxidation of an outer layer of the liquid eutectic metal. The oxidation of the outer layer forms a solid outer shell 102 that surrounds a liquid eutectic metal core 104. Once the solder particle is formed, the core 104 remains a liquid at ambient conditions until the outer shell 102 is ruptured via mechanical stress, such as an impact or increase in pressure, or chemical etching of the outer shell 102 by an acid. The solder particle 100 can be suspended in a medium, such as, but not limited to, water-based liquids, oil-based liquids, or ethanol-based liquids, to form a solder suspension that can be applied to a surface as a coating.

When the outer shell is ruptured, the liquid metal in the core 104 is exposed to the ambient environmental conditions, the oxide fragments that made up the shell, and any surfaces the solder particle was in contact with. This exposure causes the liquid metal to rapidly solidify and create a bond between adjacent surfaces in contact with the solder particles 100.

Figure 2:
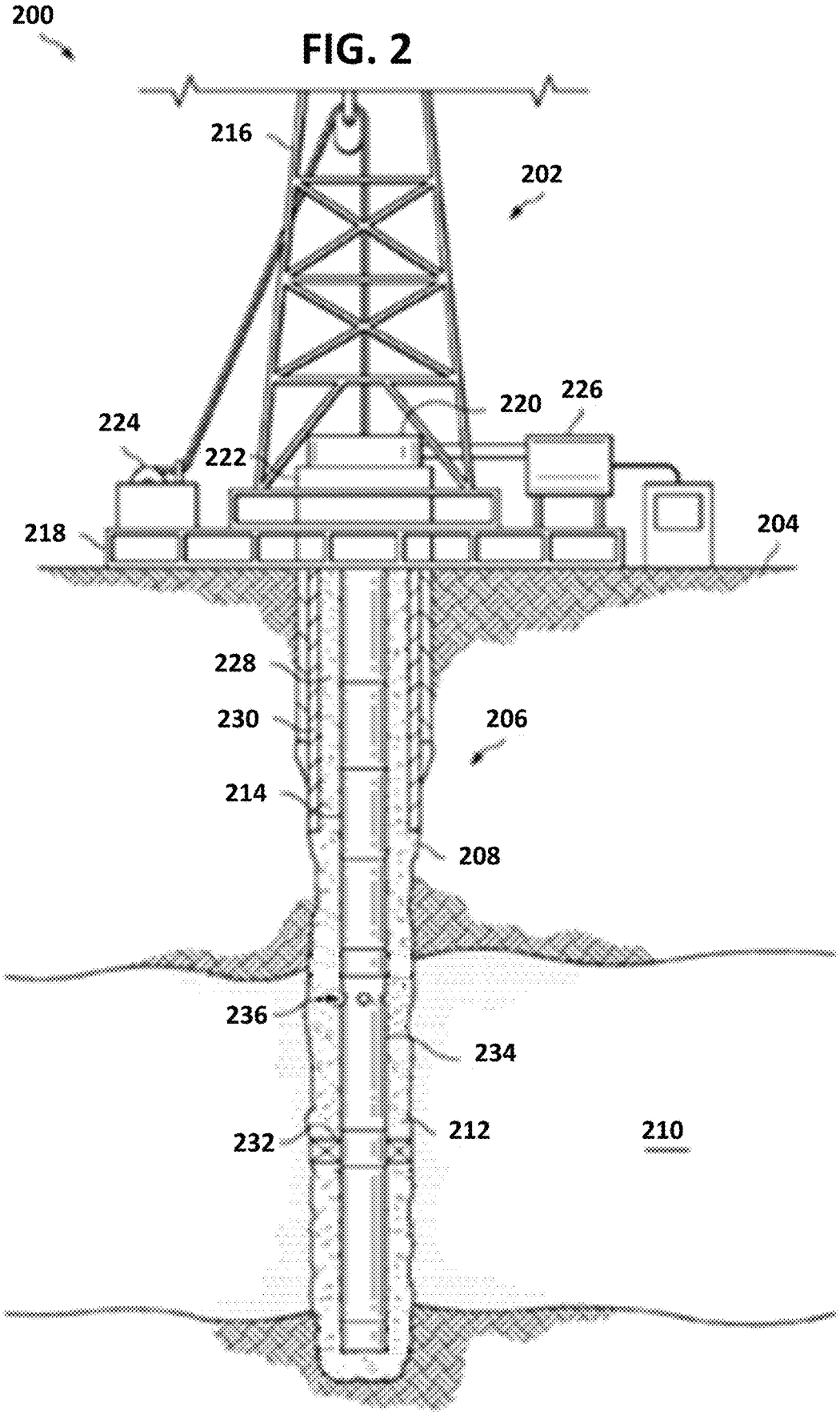
FIG. 2 is a diagram of a well system, according to one or more embodiments.

Turning now to FIG. 2, FIG. 2 is a diagram of a well system 200, according to one or more embodiments. The well system 200 includes a rig 202 atop a surface 204 of a well 206. Beneath the rig 202, a borehole 208 is formed within a geological formation 210, which is expected to produce hydrocarbons in the form of production fluid 212. The borehole 208 may be formed in the geological formation 210 using a drill string that includes a drill bit to remove material from the geological formation 210. The borehole 208 of FIG. 1 is shown as being near-vertical, but may be formed at any suitable angle to reach a hydrocarbon-rich portion of the geological formation 210. In some embodiments, the borehole 208 may follow a vertical, partially-vertical, angled, or even a partially-horizontal path through the geological formation 210.

A casing string 214 is deployed from the rig 202, which may be a drilling rig, a completion rig, a workover rig, or another type of rig. The rig 202 includes a derrick 216 and a rig floor 218. The casing string 214 extends downward through the rig floor 218, through a fluid diverter 220 and blowout preventer 222 that provide a fluidly sealed interface between the borehole 208 and external environment, and into the borehole 208 and geological formation 210. The rig 202 may also include a motorized winch 224 and other equipment for extending the casing string 214 and other tools into the borehole 208 and positioning the casing string 214 or other tools at a selected depth within the borehole 208. Coupled to the fluid diverter 220 is a pump 226. The pump 226 is operational to deliver or receive fluid through an internal bore of the casing string 214 by applying a positive or negative pressure to the internal bore. The pump 226 may also deliver or receive fluid through an annulus 228 formed between the wall of the borehole 208 and an exterior of the casing string 214 by applying a positive or negative pressure to the annulus 228. The annulus 228 is formed between the casing string 214 and a wellbore casing 230 when casing string 214 is disposed within the wellbore 208.

Following formation of the borehole 208, the casing string 214 may be equipped with tools and deployed within the borehole 208 to prepare, operate, or maintain the well 206. Specifically, the casing string 214 may incorporate tools that are actuated after deployment in the borehole 208, including without limitation bridge plugs, composite plugs, cement retainers, high expansion gauge hangers, straddles, and packers. Actuation of such tools may result in centering the casing string 214 within the borehole 208, anchoring the casing string 214, isolating a segment of the borehole 208, or other functions related to positioning and operating the casing string 214. In the illustrative embodiment shown in FIG. 2, the casing string 214 is depicted with a packer 232. The packer 232 is configured to provide fluid seals between the casing string 214 and the borehole 208, thereby defining intervals within the borehole 208. Packers 232 are typically used to prepare the borehole 208 for operations such as fracturing of the formation, acidizing, or multi-stage cementing.

Between the packers 232 is a downhole tool 234, such as valve, that controls the flow of production fluid 212 into the casing string 214. Although FIG. 2 depicts the downhole tool 234 as being separated by packer a 232, this illustration is not intended as limiting, and other arrangements of downhole tools 234 in the casing string 214 are possible. For example, a downhole tool 234 may be integrated into the casing string 214 adjacent hydraulic fracturing sleeves. Furthermore, while FIG. 2 presents the casing string 214 as having one downhole tool 234, such presentation is for purposes of illustration only. The present disclosure is not limited to any particular number of downhole tools 234 or arrangement of downhole tools 234 relative to a packer 232, or any particular type of borehole operation.

When operated, the downhole tool 234 exposes or covers one or more flow ports 236 of the downhole tool 234. When exposed, flow ports 236 allow fluid to into or out of the casing string 214. It is noted that while the operating environment shown in FIG. 2 relates to a stationary, land-based rig for raising, lowering, and setting the casing string 214, in alternative embodiments, mobile rigs, wellbore servicing units (e.g., coiled tubing units, slickline units, or wireline units), and the like may be used to lower the casing string 214. Furthermore, while the operating environment is generally discussed as relating to a land-based well, the systems and methods described herein may instead be operated in subsea well configurations accessed by a fixed or floating platform.

Figure 3:
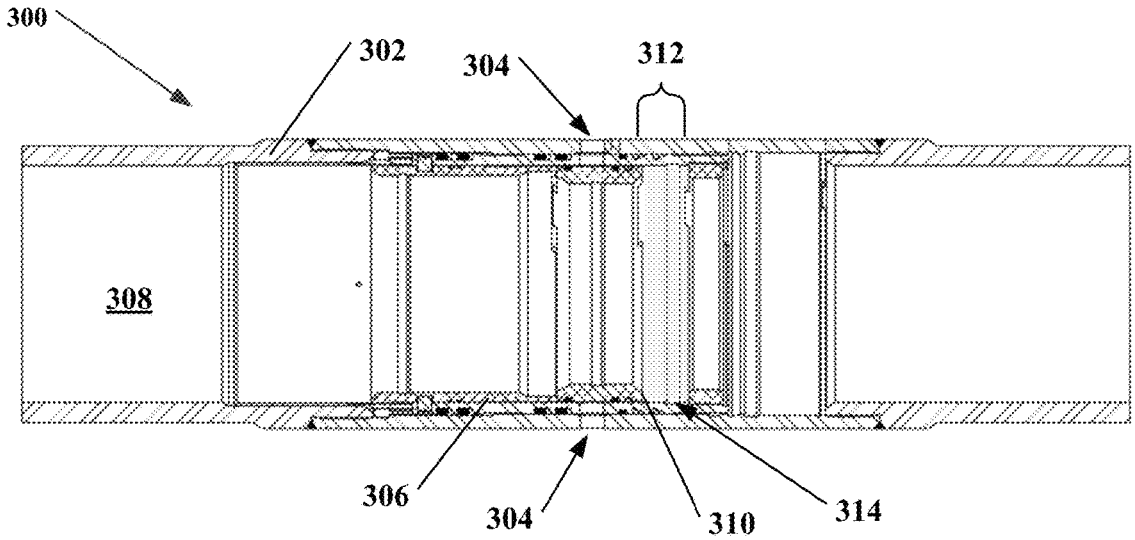
FIG. 3 is a cross-sectional diagram of a downhole tool in a run-in position, according to one or more embodiments.
Figure 4:
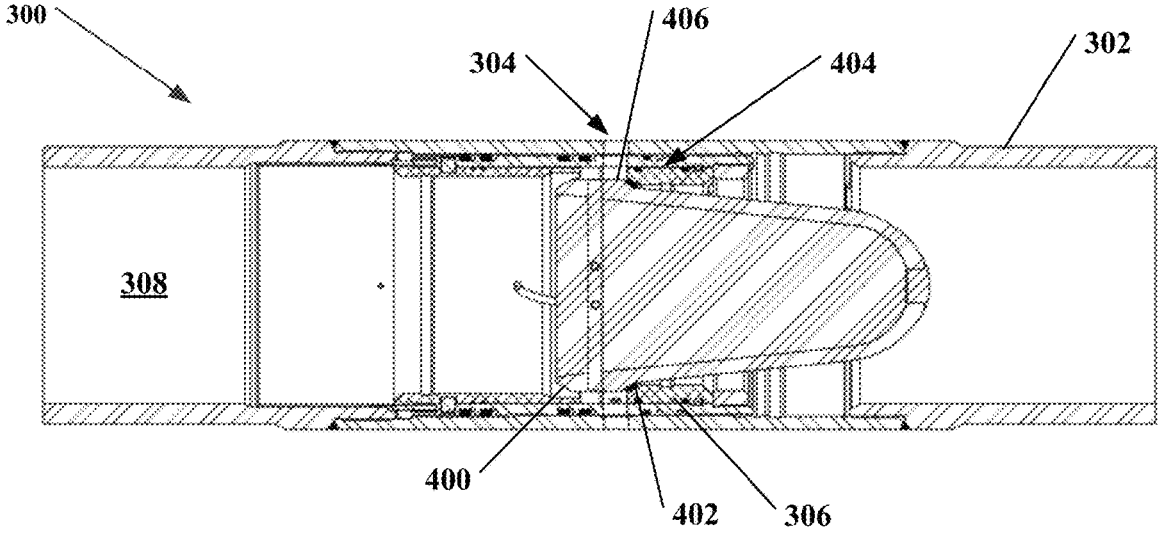
FIG. 4 is a cross-sectional diagram of the downhole tool of FIG. 3 in an actuated position.

Turning now to FIGS. 3 and 4, FIGS. 3 and 4 are a cross-sectional diagrams of a downhole tool 300, according to one or more embodiments. The downhole tool 300 is positionable between a run-in position in which the valve is closed and an open position, as described in more detail below. The downhole tool 300 includes a tubular body 302 that includes one or more ports 304 and an inner sleeve 306 slidable within the tubular body 302. The inner sleeve 306 is initially held in the run-in position via a shear pin or similar means known to those skilled in the art to block the ports 304 and prevent fluid from passing from the bore 308 of the downhole tool, through the ports 304, and into an annulus surrounding the downhole tool 300. Either or both of a downhole surface 310 of the inner sleeve 306 or a downhole portion 312 of an inner surface 314 of the tubular body 302 are coated in the solder suspension.

When the downhole tool 300 is to be opened, a plug 400 is pumped downhole and impacts a seat 402 coupled to or formed in an uphole portion 404 of the inner sleeve 306. The pressure applied to the plug 400 is great enough that the locking mechanism holding the inner sleeve 306 in the run-in position is overcome and the inner sleeve 306 slides into an open position, as shown in FIG. 4. The movement to the open position opens the ports 304 in the tubular body 302 and allows fluid to flow out from the bore 308 of the downhole tool 300. Either or both of a contact surface 406 of the plug 400 or the seat 402 of the inner sleeve 306 are coated in the solder suspension. The impact between the plug 400 and the seat 402 ruptures the shells of the solder particles, allowing the liquid eutectic metal core to solidify and bond the plug 400 to the inner sleeve 306. The bond between the seat 402 and the plug 400 prevents relative rotation between the downhole tool 300 and the plug 400. Additionally, the solidified metal from the solder particles may form a seal between the plug 400 and the inner sleeve 306.

As the inner sleeve slides 306 within the body to the open position shown in FIG. 4, the downhole surface 310 of the inner sleeve 306 contacts the tubular body 302. The impact between the tubular body 302 and the downhole surface 310 of the inner sleeve 306 ruptures the shells of the solder particles, allowing the liquid eutectic metal core to solidify and bond the inner sleeve 306 to the tubular body 302 in the open position. Similarly, the sliding movement of the inner sleeve 306 along the downhole portion 312 of the inner surface 314 of the tubular body 302 causes the solder particles to rupture and bond the inner sleeve 306 to the tubular body 302 in the open position. In at least one embodiment, the solidified metal between the tubular body 302 and the inner sleeve 306 also forms a seal between the tubular body 302 and the inner sleeve 306.

Figure 5:
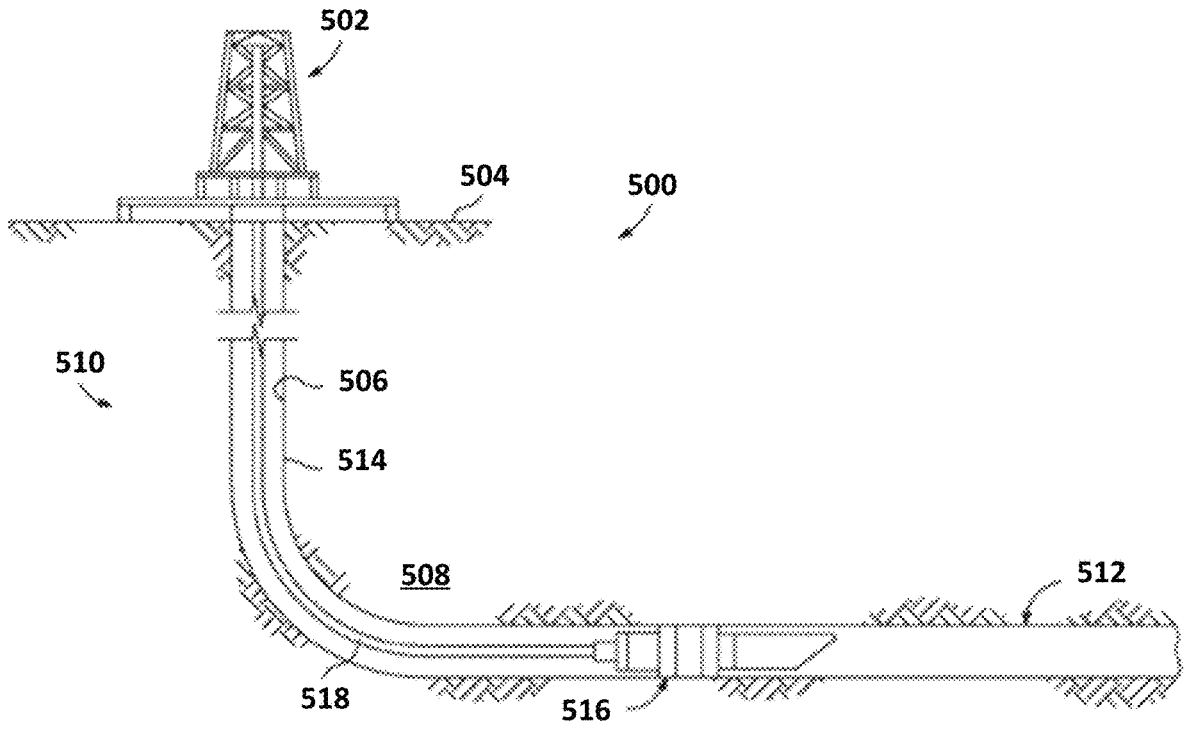
FIG. 5 is a diagram of a well system, according to one or more embodiments.

Turning now to FIG. 5, FIG. 5 is a diagram of a well system 500, according to one or more embodiments. As illustrated, the well system 500 may include a rig 502 that is positioned on the Earth's surface 504 and extends over and around a borehole 506 that penetrates a subterranean formation 508. The rig 502 may be a drilling rig, a completion rig, a workover rig, or any other type of rig used in oil and gas operations. In some embodiments, the rig 502 may be replaced with a standard surface wellhead completion or installation. While the well system 500 is depicted as a land-based operation, it will be appreciated that the principles of the present disclosure could equally be applied in any sea-based or sub-sea application where the rig 502 may be a floating platform or sub-surface wellhead installation.

The borehole 506 is drilled into the subterranean formation 508 using any suitable drilling technique and extends in a substantially vertical direction away from the Earth's surface 504 over a vertical borehole portion 510. At some point in the borehole 506, the vertical borehole portion 510 may deviate from vertical and transition into a deviated borehole portion 512 that may be, for example, substantially horizontal, although such deviation is not required. In other embodiments, the borehole 506 may be vertical, horizontal, or deviated. In some embodiments, the borehole 506 may be supported by cementing casing 514 within the borehole 506. The casing 514 may extend through the entire length of the borehole 506 or through only a portion of the borehole 506. As used herein, the term "casing" refers not only to casing as generally known in the art, but also to borehole liner, which comprises tubular sections coupled end to end but not extending to a surface location. In other embodiments, however, the casing 514 may be omitted from all or a portion of the borehole 506 and the principles of the present disclosure may equally apply to an "open-hole" environment.

The well system 500 further includes a borehole isolation device 516 as described in more detail below. The borehole isolation device 516 is conveyed into the borehole 506 on a conveyance 518 that extends from the service rig 502. The conveyance 518 that delivers the borehole isolation device 516 downhole may be, but is not limited to, wireline, slickline, an electric line, coiled tubing, drill pipe, production tubing, or the like. The borehole isolation device 516 is conveyed downhole to a target location (not shown) within the borehole 506 and then is actuated or "set" to seal the borehole 506 and otherwise provide a point of fluid isolation within the borehole 506.

Hydraulic fluid is pumped downhole from the rig 502 at the surface 504 to apply a fluid pressure to the borehole isolation device 516 to move or help move the borehole isolation device 516 to the target location. The conveyance 518 controls the movement of the borehole isolation device 516 as it traverses the borehole 506 and provides the necessary power to actuate and set the borehole isolation device 516 upon reaching the target location.

It will be appreciated by those skilled in the art that even though FIG. 5 depicts the borehole isolation device 516 as arranged and operating in the horizontal portion 512 of the borehole 506, the embodiments described herein are equally applicable for use in portions of the borehole 506 that are vertical, deviated, or otherwise slanted. It should also be noted that a plurality of borehole isolation devices 516 may be placed in the borehole 506 to divide the borehole 506 into smaller intervals or "zones" for hydraulic stimulation.

Figure 6:
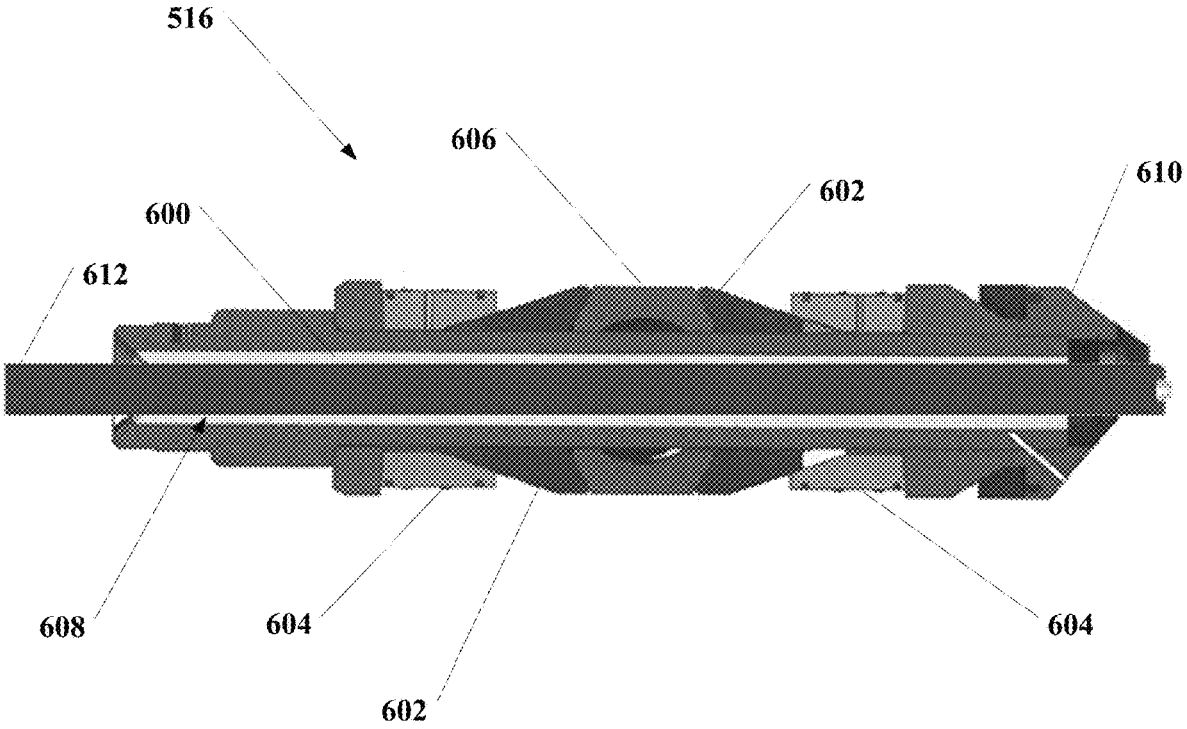
FIG. 6 is the downhole tool of FIG. 5 in a run-in position, according to one or more embodiments.

FIG. 6 is a cross-sectional diagram of the borehole isolation device 516 of FIG. 1. The borehole isolation device 516 includes a body 600, wedges 602, slips, 604, a sealing element 606, a central bore 608, and a mule shoe 610. Further, the borehole isolation device 516 is positioned on a setting tool 612 as it is conveyed downhole on a conveyance 518.

Once the borehole isolation device 516 reaches the target location within the borehole 506, fluid is no longer pumped downhole. The setting tool 612 then compresses the borehole isolation device 516 to shift the slips 604 up the wedges 602 to expand the slips 604, retaining the borehole isolation device 516 within the casing 514. As this occurs, the wedges 602 also shift inward towards the sealing element 606, compressing the sealing element 606 and creating a seal between the sealing element 606 and the casing 514. The conveyance 518 and setting tool 612 can then be withdrawn from the borehole and a sealing ball or plug (not shown) can be pumped downhole to contact and seal against the body 600, preventing fluid from traveling through the central bore 608 of the borehole isolation device 516.

In at least one embodiment, the sealing element 606 is coated in the solder suspension. The compression of the sealing element 606 against the casing 514 ruptures the solder particles and the liquid metal solidifies, creating a bond between the sealing element 606 and the casing 514. The solidified metal may also form a seal between the sealing element 606 and the casing 514. In other embodiments, the solidified metal may also prevent extrusion of the sealing element 606 as it is compressed against the casing 514. The body 600, wedges 602, and/or slips 604 may also be coated in the solder suspension such that when the borehole isolation device 516 is set within the casing 514, the solder particles rupture and the solidified metal maintains the wedges 602 and slips 604 in the set position.

Further examples include:

Example 1 is a downhole tool for use within a borehole. The downhole tool includes a body including a port that allows fluid flow between a bore of the downhole tool and an area outside of the body and a sleeve slidable from a run-in position to an actuated position. Either the run-in position or the actuated position prevents flow through the port. Additionally, at least one of an end of the sleeve or a surface of the body is coated in solder particles having an outer shell and a liquid metal core. Further, the solder particles are rupturable when the sleeve is shifted to the actuated position into contact with the surface to expose the liquid metal such that the liquid metal solidifies and forms a bond to retain the sleeve in the actuated position.

In Example 2, the embodiments of any preceding paragraph or combination thereof further include wherein the solder particles are rupturable upon contact with the sleeve such that the liquid metal solidifies and forms a seal between the end of the sleeve and the surface.

In Example 3, the embodiments of any preceding paragraph or combination thereof further include wherein the sleeve is positioned within the body.

In Example 4, the embodiments of any preceding paragraph or combination thereof further include wherein a portion of an inner surface of the body is coated in the solder particles such that the solder particles are rupturable by contact with an outer surface of the sleeve to bond the sleeve to a second portion of the body when the liquid metal solidifies.

In Example 5, the embodiments of any preceding paragraph or combination thereof further include wherein, when the solder particles are ruptured by contact with the sleeve, the solidified metal creates a seal between the sleeve and the portion of the inner surface.

In Example 6, the embodiments of any preceding paragraph or combination thereof further include wherein the sleeve includes a seat shaped to receive a plug to shift the sleeve into the actuated position.

In Example 7, the embodiments of any preceding paragraph or combination thereof further include wherein the seat is coated with solder particles rupturable by contact between the seat and the plug such that the liquid metal inside the solder particles is exposed and solidifies to bond the seat to the plug.

In Example 8, the embodiments of any preceding paragraph or combination thereof further include wherein, when the solder particles are ruptured by contact with the plug, the solidified metal creates a seal between the seat and the plug.

In Example 9, the embodiments of any preceding paragraph or combination thereof further include a packer positioned on an exterior of the body that, when actuated to contact an inner surface of the borehole or a casing in the borehole, seals between the downhole tool and the inner surface of the borehole or the casing in the borehole.

In Example 10, the embodiments of any preceding paragraph or combination thereof further include wherein at least a portion of the packer is coated in solder particles having an outer shell and a liquid metal core rupturable by contact between the packer and the inner surface of the borehole or the casing in the borehole such that the liquid metal solidifies, bonds, and seals between the packer and the inner surface of the borehole or the casing in the borehole.

In Example 11, the embodiments of any preceding paragraph or combination thereof further include wherein at least a portion of the packer is coated in solder particles having an outer shell and a liquid metal core rupturable by contact between the packer and the inner surface of the borehole or the casing in the borehole such that the liquid metal solidifies and bonds the packer and the inner surface of the borehole or the casing in the borehole to at least partially prevent extrusion of the packer.

Example 12 is a downhole tool for use with a plug in a borehole. The downhole tool includes a body having a bore extending therethrough and a seat shaped to receive the plug. The seat is coated in solder particles having an outer shell and a liquid metal core rupturable by contact between the seat and the plug to expose the liquid metal and bond the seat and the plug when the liquid metal solidifies.

In Example 13, the embodiments of any preceding paragraph or combination thereof further include wherein the solidified metal creates a seal between the seat and the plug when the solder particles are ruptured by contact with the plug.

In Example 14, the embodiments of any preceding paragraph or combination thereof further include a packer positioned on an exterior of the body that, when actuated to contact an inner surface of the borehole or a casing in the borehole, seals between the downhole tool and the inner surface of the borehole or the casing in the borehole.

In Example 15, the embodiments of any preceding paragraph or combination thereof further include wherein at least a portion of the packer is coated in solder particles having an outer shell and a liquid metal core rupturable by contact between the packer and the inner surface of the borehole or the casing in the borehole such that the liquid metal solidifies and bonds the packer and the inner surface of the borehole or the casing in the borehole to at least partially prevent extrusion of the packer.

In Example 16, the embodiments of any preceding paragraph or combination thereof further include wherein at least a portion of the packer is coated in solder particles having an outer shell and a liquid metal core rupturable by contact between the packer and the inner surface of the borehole or the casing in the borehole such that the liquid metal solidifies and bonds the packer and the inner surface of the borehole or the casing in the borehole to at least partially prevent extrusion of the packer.

In Example 17, the embodiments of any preceding paragraph or combination thereof further include wherein the body includes a port that allows fluid flow between a bore of the downhole tool and an area outside of the body and the downhole tool further includes a sleeve slidable from a run-in position to an actuated position, wherein either the run-in position or the actuated position prevents flow through the port.

In Example 18, the embodiments of any preceding paragraph or combination thereof further include wherein at least one of an end of the sleeve or a surface of the body is coated in solder particles having an outer shell and a liquid metal core and the solder particles are rupturable when the sleeve is shifted to the actuated position into contact with the surface to expose the liquid metal such that the liquid metal solidifies and forms a bond to retain the sleeve in the actuated position.

Example 19 is a plug for use with a downhole tool including a seat. The plug includes a contact surface shaped to contact and seal against the seat of the downhole tool and a solder particles comprising an outer shell and a liquid metal core coating the contact surface. The solder particles are rupturable by contact between the contact surface and the seat such that the liquid metal solidifies and bonds the plug to the seat.

In Example 20, the embodiments of any preceding paragraph or combination thereof further include wherein the solidified metal creates a seal between the seat and the plug when the plug contacts the seat.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A downhole tool for use within a borehole, the downhole tool comprising:

a body comprising a port that allows fluid flow between a bore of the downhole tool and an area outside of the body;

a sleeve slidable from a run-in position to an actuated position, wherein either the run-in position or the actuated position prevents flow through the port;

a packer positioned on an exterior of the body that, when actuated to contact an inner surface of the borehole or a casing in the borehole, seals between the downhole tool and the inner surface of the borehole or the casing in the borehole, wherein at least a portion of the packer is coated in solder particles having an outer shell and a liquid metal core rupturable by contact between the packer and the inner surface of the borehole or the casing in the borehole such that the liquid metal solidifies, bonds, and seals between the packer and the inner surface of the borehole or the casing in the borehole;

wherein at least one of an end of the sleeve or a surface of the body is coated in solder particles having an outer shell and a liquid metal core; and wherein the solder particles coating the at least one of the end of the sleeve or the surface of the body are rupturable when the sleeve is shifted to the actuated position into contact with the surface to expose the liquid metal such that the liquid metal solidifies and forms a bond to retain the sleeve in the actuated position.

2. The downhole tool of claim 1, wherein the solder particles coating the at least one of the end of the sleeve or the surface of the body are rupturable upon contact with the sleeve such that the liquid metal solidifies and forms a seal between the end of the sleeve and the surface.

3. The downhole tool of claim 1, wherein the solder particles coating the at least one of the end of the sleeve or the surface of the body coat a portion of an inner surface of the body such that the solder particles coating the inner surface of the body are rupturable by contact with an outer surface of the sleeve to bond the sleeve to a second portion of the body when the liquid metal solidifies.

4. The downhole tool of claim 3, wherein, when the solder particles coating the inner surface of the body are ruptured by contact with the sleeve, the solidified metal creates a seal between the sleeve and the portion of the inner surface.

5. The downhole tool of claim 3, wherein the sleeve comprises a seat shaped to receive a plug to shift the sleeve into the actuated position.

6. The downhole tool of claim 5, wherein the seat is coated with solder particles rupturable by contact between the seat and the plug such that liquid metal inside the solder particles coating the seat is exposed and solidifies to bond the seat to the plug.

7. The downhole tool of claim 6, wherein the bond between the seat and the plug prevents relative rotation between the downhole tool and the plug.

8. The downhole tool of claim 6, wherein, when the solder particles coating the seat are ruptured by contact with the plug, the solidified metal creates a seal between the seat and the plug.

9. The downhole tool of claim 1, wherein the solder particles coating the at least the portion of the packer are rupturable by contact between the packer and the inner surface of the borehole or the casing in the borehole such that the liquid metal solidifies and bonds the packer and the inner surface of the borehole or the casing in the borehole to at least partially prevent extrusion of the packer.

10. A downhole tool for use with a plug in a borehole, the downhole tool comprising:

a body having a bore extending therethrough;

a seat shaped to receive the plug, the seat coated in solder particles having an outer shell and a liquid metal core rupturable by contact between the seat and the plug to expose the liquid metal and bond the seat and the plug when the liquid metal solidifies; and a packer positioned on an exterior of the body that, when actuated to contact an inner surface of the borehole or a casing in the borehole, seals between the downhole tool and the inner surface of the borehole or the casing in the borehole, wherein at least a portion of the packer is coated in solder particles having an outer shell and a liquid metal core rupturable by contact between the packer and the inner surface of the borehole or the casing in the borehole such that the liquid metal solidifies and bonds the packer and the inner surface of the borehole or the casing in the borehole to at least partially prevent extrusion of the packer.

11. The downhole tool of claim 10, wherein the solidified metal creates a seal between the seat and the plug when the solder particles coating the seat are ruptured by contact with the plug.

12. The downhole tool of claim 10, wherein the solder particles coating the at least the portion of the packer are rupturable by contact between the packer and the inner surface of the borehole or the casing in the borehole such that the liquid metal solidifies and bonds the packer and the inner surface of the borehole or the casing in the borehole to at least partially prevent extrusion of the packer.

13. The downhole tool of claim 10, wherein the body comprises a port that allows fluid flow between a bore of the downhole tool and an area outside of the body and the downhole tool further comprises a sleeve slidable from a run-in position to an actuated position, wherein either the run-in position or the actuated position prevents flow through the port.

14. The downhole tool of claim 13, wherein at least one of an end of the sleeve or a surface of the body is coated in solder particles having an outer shell and a liquid metal core and the solder particles coating the at least one of the end of the sleeve or the surface of the body are rupturable when the sleeve is shifted to the actuated position into contact with the surface to expose the liquid metal such that the liquid metal solidifies and forms a bond to retain the sleeve in the actuated position.

15. A downhole tool for use within a borehole, the downhole tool comprising:

a body comprising a port that allows fluid flow between a bore of the downhole tool and an area outside of the body;

a sleeve slidable from a run-in position to an actuated position, wherein either the run-in position or the actuated position prevents flow through the port; and a packer positioned on an exterior of the body that, when actuated to contact an inner surface of the borehole or a casing in the borehole, seals between the downhole tool and the inner surface of the borehole or the casing in the borehole, wherein at least a portion of the packer is coated in solder particles having an outer shell and a liquid metal core rupturable by contact between the packer and the inner surface of the borehole or the casing in the borehole such that the liquid metal solidifies, bonds, and seals between the packer and the inner surface of the borehole or the casing in the borehole.

* * * * *